US005284527A

United States Patent [19]

Smeggil et al.

[11] Patent Number: 5,284,527

[45] Date of Patent: Feb. 8, 1994

[54] METHOD OF MAKING SILVER-METAL OXIDE MATERIALS AND ELECTRICAL CONTACTS

[75] Inventors: John G. Smeggil, Simsbury, Conn.; Norman J. Becker, East Detroit, Mich.

[73] Assignee: United Technologies Corporation, Hartford, Conn.

[21] Appl. No.: 823,277

[22] Filed: Jan. 21, 1992

[51] Int. Cl.[5] ..... B22F 3/24; C23C 8/12

[52] U.S. Cl. ..... 148/281; 148/431; 148/280; 419/21

[58] Field of Search ..... 148/280, 281, 283, 431; 419/21

[56] References Cited

U.S. PATENT DOCUMENTS

| | | | |
|---|---|---|---|
| Re. 31,902 | 5/1985 | Nadkarni | 75/343 |
| 1,858,210 | 5/1932 | McMaster et al. | 148/281 |
| 3,932,936 | 1/1976 | Harmsen et al. | 29/630 |
| 3,969,112 | 7/1976 | Kim et al. | 419/21 |
| 4,472,211 | 9/1984 | Shibata | 148/431 |
| 5,043,224 | 8/1991 | Jaccodine et al. | 428/446 |
| 5,098,485 | 3/1992 | Evans | 148/269 |

FOREIGN PATENT DOCUMENTS

| | | | |
|---|---|---|---|
| 0022980 | 1/1981 | European Pat. Off. | 148/431 |

OTHER PUBLICATIONS

Chemical Abstracts, vol. 88, 1978, Columbus, Ohio, US; Abstract No. 77757B, OSIPOV I.I. "Multicolored Coloration of a Thin-Film Copper Based Metallic Coating and Otkrytiya Izobret Prom. Opraztsy, Tovarnye Znaki 1977, 54(35), 88-90", p. 232, col. 88, see abstract and SU,A,573 511.

Derwent Publications Ltd., London, GB; AN 88-101298 C15 & JP,A,63 050 456 (Hitachi), Mar. 3, 1988, see Abstract.

*Primary Examiner*—John P. Sheehan
*Assistant Examiner*—Margery S. Phipps
*Attorney, Agent, or Firm*—George J. Romanik

[57] ABSTRACT

A method of making silver-metal oxide materials suitable for use in electrical contacts includes oxidizing a silver-solute metal alloy in an oxidizing atmosphere. The oxidizing atmosphere has a sufficient amount of halide to inhibit the formation of a protective oxide scale around the alloy.

13 Claims, 2 Drawing Sheets

METHOD OF MAKING SILVER-METAL OXIDE MATERIALS AND ELECTRICAL CONTACTS

TECHNICAL FIELD

The present invention is directed to silver-metal oxide materials that are suitable for use as electrical contacts.

BACKGROUND ART

Silver-metal oxide materials are used as contacts in a variety of electrical devices, such as relays, because of their high conductivity and resistance to welding that can occur between contacts. The silver provides high conductivity. The metal oxide provides resistance to welding. Currently, the contact material of choice is silver-cadmium oxide because it has the desired conductivity and weld resistance and is easy to make. Silver-cadmium oxide contact materials typically contain about 7 weight percent (wt %) to about 13 wt % oxide.

Recently, concerns about the toxicity of airborne cadmium and cadmium oxide particles have led some jurisdictions to propose regulations to lower the amount of such particles permitted in manufacturing environments. Complying with these regulations will require process changes that will make silver-cadmium oxide materials too expensive for use in many commercial applications. As a result, silver-cadmium oxide is likely to be phased out as a contact material. If that happens, silver-tin oxide is a logical successor. Silver-tin oxide does not present the same toxicity concerns as silver-cadmium oxide and can have superior contact properties. For some applications, silver-tin oxide materials with 7 wt % to 10 wt % oxide are suitable. Many applications, however, require tin oxide contents of at least about 10 wt % to provide adequate weld resistance.

Several methods for making silver-tin oxide contact materials are available. The most straightforward method is to oxidize tin in a silver-tin alloy. When exposed to oxidizing conditions, however, the silver-tin alloy forms an undesirable, tenacious, protective oxide scale that inhibits internal oxidation. As a result, this method cannot make materials with more than about 8 wt % tin oxide. Efforts to overcome this limitation by oxidizing silver-tin alloys in high pressure, pure oxygen atmospheres have been unsuccessful.

Silver-tin oxide materials also can be made by blending and compacting tin oxide powders with silver powders. Materials made with this method can contain more than 10 wt % tin oxide. Often, though, they have flaws that make them unsuitable for electrical contacts. For example, agglomerations of tin oxide particles can create cracks and other physical defects when the material is cold worked to make contacts. The agglomerations form because it is difficult to mix the tin oxide and silver powders uniformly. Efforts to improve mixing by varying the size of the tin oxide powder have been unsuccessful. Another defect found in blended silver-tin oxide materials is due to internal flaws in individual tin oxide particles. These flaws, especially prevalent in particles more than 5 μm in diameter, also create cracks and other physical defects in the silver-tin oxide materials when they are cold worked to make contacts.

At least two other methods of making silver-tin oxide materials are available. In one method, an insoluble tin compound is precipitated from an aqueous solution onto a silver powder. The tin compound is converted to tin oxide and the silver-tin oxide material is consolidated into a suitable form. In the other method, tin and silver compounds are coprecipitated from an aqueous solution. As before, the tin compound is converted to tin oxide and the material is consolidated into an appropriate form. While capable of producing acceptable silver-tin oxide materials, both methods are costly and difficult to adapt for commercial scale production.

Therefore, what is needed in the industry is a method of making silver-metal oxide contact materials that contain adequate amounts of oxide and can be made into electrical contacts.

DISCLOSURE OF THE INVENTION

The present invention is directed to a method of making silver-metal oxide contact materials that contain adequate amounts of oxide and can be made into electrical contacts.

One aspect of the invention includes a method of making silver-metal oxide materials by oxidizing a silver-solute metal alloy in an oxidizing atmosphere that has a sufficient amount of halide to inhibit the formation of a protective oxide scale around the alloy. The silver-metal oxide materials are suitable for use in electrical contacts.

These and other features and advantages of the present invention will become more apparent from the following description and accompanying drawings.

BEST MODE FOR CARRYING OUT THE INVENTION

Figure 1:
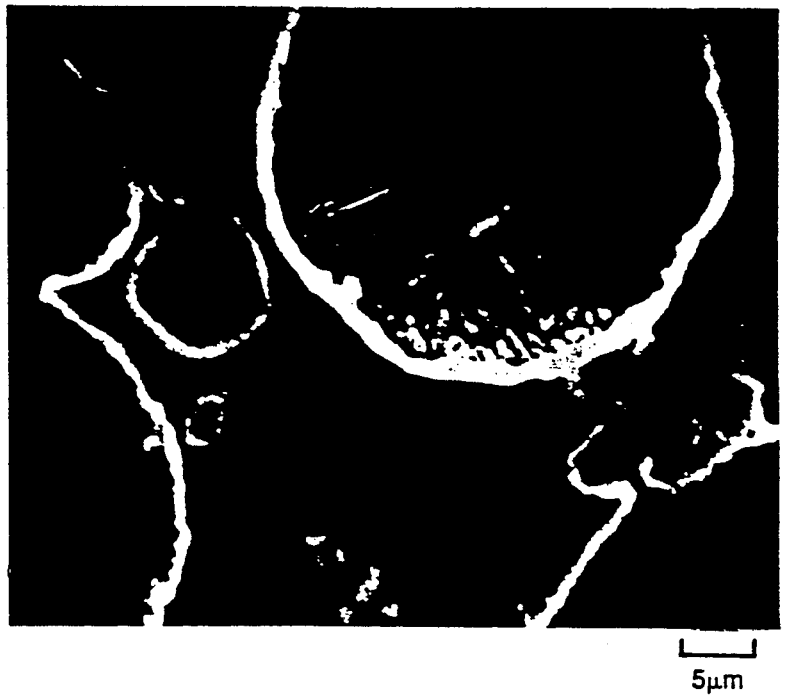
FIG. 1 is an electron micrograph of a silver-tin alloy powder oxidized by a prior art method.

The present invention can be used with any alloy of silver and a solute metal that forms a protective oxide scale under ordinary oxidizing conditions. Suitable solute metals include tin, zinc, indium, molybdenum, tantalum, zirconium, niobium, nickel, thallium, tungsten, and titanium. The invention also can be used with alloys that comprise more than two metals, especially when the additional metals are present in small amounts, such as less than about 5 wt % and, preferably, less than about 2 wt %. For example, the alloys may contain small amounts of molybdenum, tungsten, titanium, or beryllium as sintering aids, as is known in the art of making electrical contacts. These materials will be oxidized with the solute metal when the alloy is exposed to oxidizing conditions. The alloy may be in any convenient physical form, such as a powder, wire, ingot, or any other conventional form. Preferably, the alloy will be a powder to increase the surface area available for oxidation. The powder particles may be any size, for example from about −325 mesh to about +235 mesh. Smaller particles may be desirable to increase surface area.

The key to the invention is oxidizing the silver-metal alloy in an atmosphere that contains a small amount of a gaseous halide. The halide acts as a corrodent to prevent a uniform, protective oxide scale from forming on the surface of the alloy. As a result, oxygen can penetrate the alloy to react with the solute metal and form fine, well dispersed metal oxide particles inside the alloy. The amount of metal oxide made with this method is limited only by the amount of solute metal in the alloy. The invention will work with any halide. Chloride is the preferred halide because it is highly corrosive and readily available. The amount of halide in the oxidizing atmosphere is not critical. For example, halide concentrations may range from less than 0.001 ppm to more than 1000 ppm. Preferably, the oxidizing atmosphere will have about 0.01 ppm to about 1000 ppm halide. The halide may be introduced into the oxidizing atmosphere by any means. For example, a halide-containing salt, such as NaCl, NaF, KCl, KF, or $NH_4Cl$, can be mixed with the alloy powder before it is oxidized. The halide salt establishes an equilibrium gaseous concentration over the alloy, producing the halide-containing atmosphere. Alternately, a halide salt or other halide-containing compound can be placed in proximity to the alloy so the halide establishes an equilibrium concentration in the oxidizing atmosphere. Still another way to introduce a gaseous halide into the oxidizing atmosphere is to bubble an aqueous solution of a halide-containing compound, such as an aqueous HCl solution, into an oxidizing furnace that contains the alloy.

The silver-metal alloy can be oxidized under a broad range of conditions using equipment, such as an oxidizing furnace, that is well known in the art. The oxidizing atmosphere can be any atmosphere that contains sufficient oxygen to oxidize the solute metal and sufficient gaseous halide to prevent a protective oxide scale from forming. Air is the preferred source of oxygen, although oxygen-enriched air or pure oxygen may be used if desired. The pressure can range from atmospheric to superatmospheric, as desired. Any temperature below the melting point of the alloy that allows the oxidation to be completed in a reasonable time is satisfactory. Preferably, the oxidation will be done at a low temperature to permit the reaction to proceed slowly. For example, a temperature of about 677° C. (1250° F.) to about 788° C. (1450° F.) may be desirable. A slow oxidation promotes the formation of many small, well dispersed oxide particles in the material. If the gaseous halide is supplied by a solid salt, the oxidation temperature also should be below the salt's melting point to avoid the rapid corrosive action of a molten salt.

To make the silver-metal oxide material of the present invention, a silver-metal alloy in any suitable form is heated to a suitable oxidizing temperature in an oxidizing atmosphere that contains a small amount of a gaseous halide. Oxidizing conditions are maintained until the desired amount of metal oxide is produced. The time needed to produce the metal oxide depends on the temperature and oxygen partial pressure of the oxidizing atmosphere. If desired, a portion of the solute metal can be left unoxidized to enhance the electrical resistance, alloy hardness, or other properties of the final material. One way to do this is to remove the halide from the oxidizing atmosphere before all of the solute metal has oxidized. When the halide is removed, a protective scale forms on the alloy and further oxidation stops. Another way to stop the oxidation is to remove the alloy from the oxidizing atmosphere. Residual halide on the silver-metal oxide material can be removed by continuing to heat the material for a short time after the halide has been removed from the oxidizing atmosphere or by thoroughly washing the material to remove all traces of the halide. This step is particularly important if the halide was chloride because chloride is very corrosive. Residual halide in the finished material could cause the material to deteriorate over time or can damage surrounding equipment. The silver-metal oxide material can then be formed into electrical contacts or any other article by methods that are well known in the art. For example, a silver-metal oxide powder can be consolidated into an ingot and the ingot can be draw into a wire. The wire can be cut to an appropriate size and headed to form an electrical contact. Cold working the material with these or any other techniques improves the oxide distribution in the material, thereby improving the material's properties.

The following examples are given to demonstrate the present invention without limiting the invention's broad scope.

EXAMPLE 1

To demonstrate the drawbacks of the prior art internal oxidation method, one gram of a −325 mesh silver-tin alloy powder was oxidized in air at 649° C. (1200° F.) and atmospheric pressure. The alloy initially contained 9.7 wt % tin. After 70 hours at the oxidizing conditions, a little more than half the tin had been converted to tin oxide to produce a material with 6.6 wt % tin oxide. The oxidized alloy still had 4.4 wt % tin that was not oxidized. Tin oxidation was limited by the formation of a uniform, 0.4 μm thick protective tin oxide scale around the powder's particles. The oxide scale appears in FIG. 1 as a white shell around the alloy particles.

EXAMPLE 2

Figure 2:
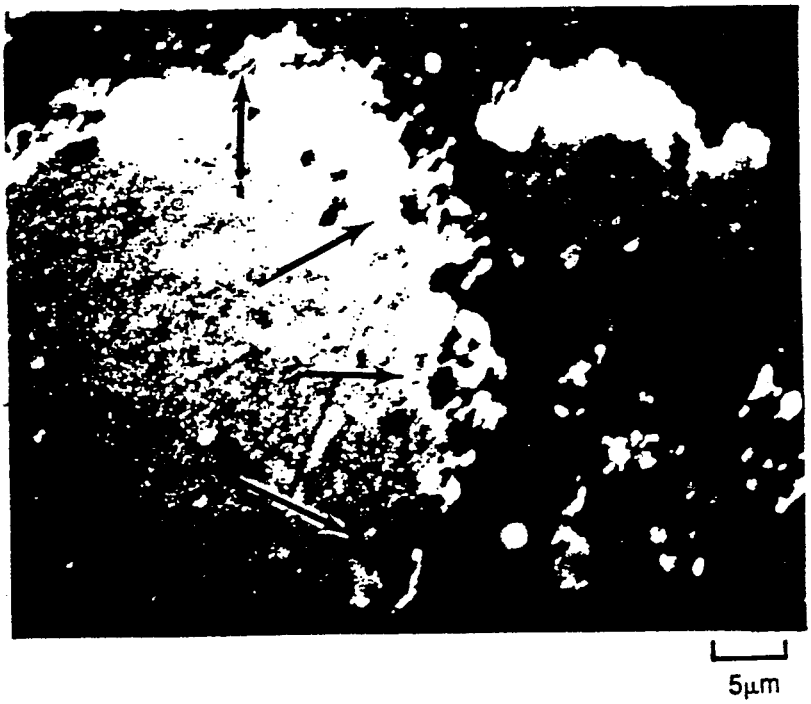
FIG. 2 is an electron micrograph of a silver-tin alloy powder oxidized at 649° C. (1200° F.) by the method of the present invention.

To demonstrate the present invention, one gram of the powder used in Example 1 was oxidized in air at 649° C. and atmospheric pressure for 70 hours. 25 mg of NaCl were added to the silver-tin powder to produce a NaCl partial pressure of about 0.0046 torr, which yielded a concentration of about 12 ppm NaCl. After 70 hours, the powder was removed from the oxidizing atmosphere, cooled, and analyzed. Analysis showed that the material had 11.0 wt % tin oxide and about 0.8 wt % unoxidized tin. FIG. 2 shows that the oxidized powder particles had an irregular, poorly adherent scale, the feature to which the arrows point, on their surfaces. This scale, unlike the scale shown in FIG. 1, did not interfere with the formation of oxide particles in the interior of the alloy particles.

EXAMPLE 3

Figure 3:
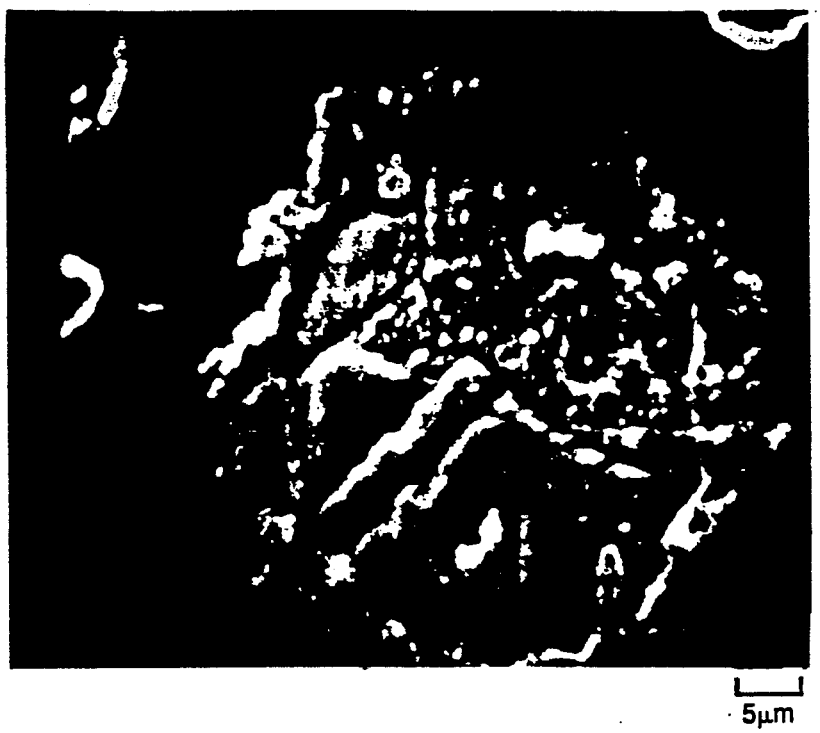
FIG. 3 is an electron micrograph of a sectioned silver-tin alloy particle that was oxidized at 732° C. (1350° F.) by the method of the present invention.
Figure 4:
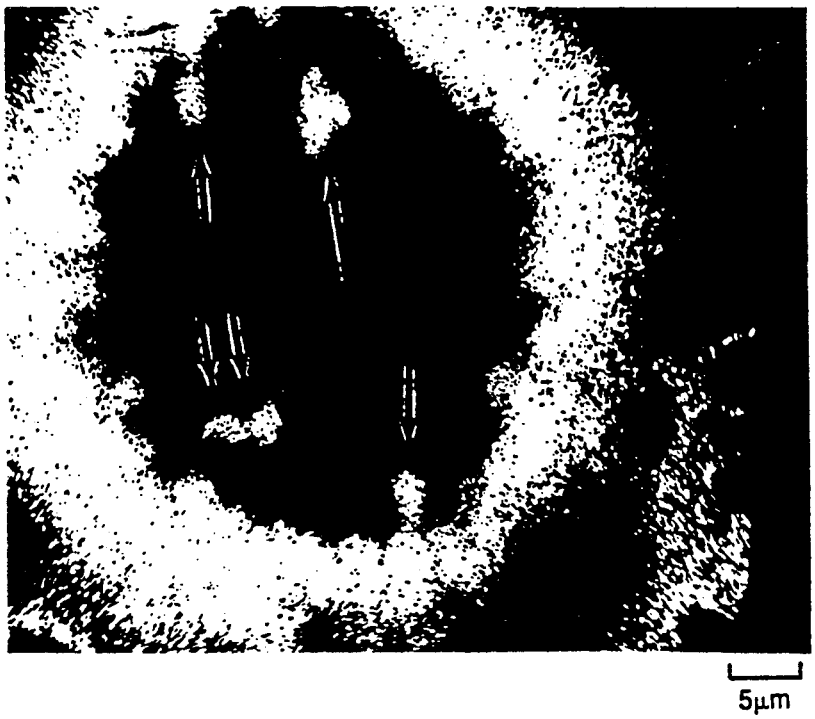
FIG. 4 is an x-ray map of the sectioned silver-tin alloy particle from FIG. 3 that shows the location of tin oxide particles within the alloy particle.

One gram of the powder used in Example 1 was oxidized in air at 732° C. (1350° F.) and atmospheric pressure for 4 hours. 25 mg of NaCl were added to the silver-tin powder to produce a low concentration of gaseous NaCl in the oxidizing atmosphere. After 4 hours at oxidizing conditions, the powder was removed from the oxidizing atmosphere, cooled, and analyzed. Analysis showed that the material had 11.0 wt % tin oxide and about 0.8 wt % unoxidized tin. One of the alloy particles was sectioned to show the tin oxide particle in the center of the alloy particle. FIG. 3 is an electron micrograph of the sectioned particle after polishing and etching. The porous, loosely adherent scale observed in the sample from Example 2 is also visible in this sample. FIG. 4 is an X-ray map of the sectioned particle. The white structures against the dark central background to which the arrows point are internal tin oxide particles.

EXAMPLE 4

One gram of the powder used in Example 1 was oxidized in air at 788° C. (1450° F.) and atmospheric pressure for 2 hours. 25 mg of NaCl was mixed with the alloy powder to produce a low concentration of gaseous NaCl in the oxidizing atmosphere. After 2 hours at oxidizing conditions, the powder was removed from the oxidizing atmosphere, cooled, and analyzed. Analysis showed that the material contained 11.5 wt % tin oxide and 0.4 wt % unoxidized tin.

EXAMPLE 5

To demonstrate that halides other than chloride can be equally effective in disrupting the formation of a protective oxide scale, one gram of the powder used in Example 1 was oxidized in air at 732° C. (1350° F.) and atmospheric pressure for 4 hours. 25 mg of NaF was mixed with the alloy powder to produce a low concentration of gaseous NaF in the oxidizing atmosphere. After 4 hours at oxidizing conditions, the powder was removed from the oxidizing atmosphere, cooled, and analyzed. Analysis showed that 99.8% of the tin was converted to oxide.

The present invention provides several benefits over prior art. First, the use of a halide corrodent to interfere with the formation of a protective oxide scale on the silver-metal alloy permits materials with higher oxide contents to be made by internal oxidation. As a result, the silver-metal oxide materials of the present invention are suitable for use as electrical contacts in a broad range of applications.

Second, internal oxidation makes small, uniformly distributed metal oxide particles in the silver-metal oxide material. As a result, the materials of the present invention do not develop cracks and other physical defects when they are made into electrical contacts.

Third, the invention allows the internal oxidation to take place at relatively low temperatures in air. As a result, less elaborate equipment than is needed for prior art methods can be used for the present invention. Moreover, despite the low temperatures, high oxide contents can be produced in short times, as compared with the prior art.

The invention is not limited to the particular embodiments shown and described herein. Various changes and modifications may be made without departing from the spirit or scope of the claimed invention.

We claim:

1. A method of making silver-metal oxide materials suitable for use in electrical contacts, comprising:

oxidizing an alloy that comprises silver and a solute metal in an oxidizing atmosphere that has a sufficient amount of halide to inhibit the formation of a protective oxide scale around the alloy, thereby forming a silver-metal oxide material.

2. The method of claim 1, wherein the solute metal in the alloy is selected from the group consisting of tin, zinc, indium, molybdenum, tantalum, zirconium, niobium, nickel, thallium, tungsten, and titanium and the metal oxide in the silver-metal oxide material is an oxide of the solute metal.

3. The method of claim 1, wherein the alloy comprises a sintering aid in addition to the solute metal, wherein the sintering aid is selected from the group consisting of molybdenum, tungsten, titanium, and beryllium, and the sintering aid oxidizes in the oxidizing atmosphere.

4. The method of claim 1, wherein the alloy is in the form of a powder that is about −325 mesh to about +235 mesh.

5. The method of claim 1, wherein the oxidizing atmosphere also comprises air.

6. The method of claim 1, further comprising generating the halide in the oxidizing atmosphere by blending an effective quantity of a halide-containing compound with the alloy.

7. The method of claim 1, further comprising generating the halide in the oxidizing atmosphere by placing an effective amount of a halide-containing compound in the oxidizing atmosphere.

8. The method of claim 1, further comprising generating the halide in the oxidizing atmosphere by bubbling an effective amount of an aqueous solution of a halide-containing compound into the oxidizing atmosphere.

9. The method of claim 1, wherein the oxidizing atmosphere comprises about 0.001 ppm to about 1000 ppm halide.

10. The method of claim 1, wherein the halide is chloride.

11. The method of claim 1, wherein the silver-metal oxide material comprises at least about 11 wt % metal oxide.

12. The method of claim 1, further comprising washing the silver-metal oxide material to remove residual halides.

13. The method of claim 1, further comprising forming the silver-metal oxide material into an electrical contact.

* * * * *